US005224312A

United States Patent [19]

Buchfink

[11] Patent Number: 5,224,312

[45] Date of Patent: Jul. 6, 1993

[54] VENTING FABRIC

[75] Inventor: Adolf Buchfink, Rosengarten-Klecken, Fed. Rep. of Germany

[73] Assignee: Claudius Peters Aktiengesellschaft, Buxtehude, Fed. Rep. of Germany

[21] Appl. No.: 723,941

[22] Filed: Jul. 1, 1991

[30] Foreign Application Priority Data

Jul. 2, 1990 [DE] Fed. Rep. of Germany ... 9010061[U]

[51] Int. Cl.[5] ..... A01F 25/16

[52] U.S. Cl. ..... 52/192; 52/197

[58] Field of Search ..... 52/192–197, 52/263, 302, 303

[56] References Cited

U.S. PATENT DOCUMENTS

| | | | |
|---|---|---|---|
| 2,560,141 | 7/1951 | Tipps | 52/197 X |
| 3,426,445 | 2/1969 | Steffen | 52/192 X |
| 4,281,489 | 8/1981 | Kallestad et al. | 52/192 |
| 4,604,842 | 8/1986 | Sukup | 52/192 X |

FOREIGN PATENT DOCUMENTS

| | | | |
|---|---|---|---|
| 1918190 | 5/1963 | Fed. Rep. of Germany . | |
| 2223616 | 11/1973 | Fed. Rep. of Germany | 52/197 |
| 3523863A1 | 1/1987 | Fed. Rep. of Germany . | |
| 8709331.6 | 12/1987 | Fed. Rep. of Germany . | |

*Primary Examiner*—Richard E. Chilcot, Jr.
*Attorney, Agent, or Firm*—Chilton, Alix & Van Kirk

[57] ABSTRACT

The bulk material silo has a venting bottom containing a fiber layer (4). To compensate the difference in flow-off resistance, which differs with the distance of material from the discharge (6), it is provided that the fiber layer differs in flow resistance (10) along the path of the material toward the outlet (6), specifically having a lower flow resistance in regions further away from the outlet.

13 Claims, 1 Drawing Sheet

VENTING FABRIC

The present invention relates to a bulk material silo whose bottom comprises an air-permeable fiber layer for the finely divided permeation of air from a compressed-air feed chamber situated underneath into the silo space situated above in order to render at least the layer of bulk material which is in immediate contact with the bottom free-flowing in such a way that it is capable of moving toward a pressure relief site (for example a discharge opening) in particular under the action of air pressure and/or the pressure from the material above and/or a gradient.

The gas flow per unit area through the venting apparatus of a silo bottom depends on the pressure in the air feed chamber underneath the venting bottom, the flow resistance of the venting bottom, and the counterpressure. The counterpressure is determined by the resistance encountered by the air entering the silo space and/or by the bulk material, fluidized by this air, on the way to the nearest relief site. This resistance depends on the distance to the relief site. If the relief site is formed by the silo outlet or an outlet chamber, this resistance is significantly greater for the material in regions remote from the outlet than for the material in regions closer to the outlet. This is true in particular when the column of material in the silo space is not vented completely but only for a comparatively thin layer which, on its way to the relief site, is exposed to the friction and the pressure from the stationary, essentially unvented material above. Consequently, the conditions for removal of material from the outlet-remote bottom regions are unfavorable. This leads to worse activation of the material close to the wall. Given the common practice of very long time intervals between successive occasions when the silo is completely emptied, this leads to caking to the silo wall. This in turn greatly reduces the storage capacity of the silo. The caked material must be removed at great expense. For this reason it is desirable to involve the outlet-remote bottom regions in the transport of the material as much as those which are closer to the outlet. It is known for this purpose to subject the outlet-remote bottom regions to a higher venting pressure by allocating to them separate air feed chambers and reducing the airflow to the air feed chambers which are closer to the outlet more than to those which are more remote from the outlet. However, this is comparatively complicated, in particular if fine gradation of the air feed pressure is to be achieved with a multiplicity of air feed chambers.

The invention seeks to achieve this object in a simpler manner.

The object is achieved according to the invention when the flow resistance offered by the air-permeable fiber layer increases along the path of the material toward the relief site.

Since, according to the invention, the flow resistance is made small in outlet-remote regions, a wider pressure range is available here for venting the silo contents than in the outlet-closer regions, despite the same pressure in the air feed chamber. This has the effect that the loosening gas which has streamed through the bottom can have a higher pressure in the outlet-remote regions than in the outlet-close regions, so that a more pronounced pressure gradient results above the vent bottom from the outlet-remote regions toward the outlet with a consequent greater involvement in the outflow stream by the outlying districts.

The regionally differing flow resistance due to the air-permeable fiber layer can be achieved in various ways. In an advantageous embodiment of the invention, the spaces between the fibers of the fiber layer are permanently narrowed to a degree which differs by region. If the fiber layer consists of or contains a thermoplastic material, this can be accomplished by means of a heat treatment with or without pressing, in which case the differing narrowing is obtained as a result of fiber fusion and/or a differing degree of compaction.

In another advantageous embodiment of the invention, the spaces between the fibers, which are available for the passage of the loosening gas, are packed to a degree which varies by region, preferably by incorporation of an impregnation, i.e. a substance which can be introduced in the liquid state, solidifies in situ and then seals off a greater or smaller proportion of the pore cross-section. Instead or in addition it is also possible to introduce a finely granular or dust-like solid which will partially block the pores.

The narrowing of the spaces between the fibers does not in general need to extend to the entire thickness of the fiber layer in order for the desired reducing effect to be achieved. Since the above-explained techniques require a very fine graduation of the pressing pressure or the pressing temperatures or of the amount of substance to be introduced, and since it can be simpler locally to achieve a high degree of closure instead, it is proposed according to a further variant of the invention that the fiber layer contain small, completely or highly enclosed areas and that the proportion of these areas differs by region, while the surface parts surrounding these areas remain unaffected and therefore offer the same flow resistance per unit area in different regions. The enclosed areas can have a geometrically regular or nonregular shape. For example, the surface of the fiber layer may be compressed in a multiplicity of very small areas, distributed over the surface of the fiber layer, within which the spaces between the fibers are closed or reduced by hot pressing. The proportion of these areas as a proportion of the total area can be varied by varying their density or their size. They can be completely separate from one another or else be joined together to form strips. Of particular advantage is the form of fine strips which lead in the direction of the outlet and the width of which increases toward the outlet and/or whose spacing decreases toward the outlet. It is not necessary for the pore cross-section to be completely closed in these areas. However, the pore cross-section should at least be reduced to the extent desired in the regions closest to the outlet for the total area there.

Finally, it is also possible to assemble the fiber layer from separate pieces of differing flow resistance.

In what follows, the invention is further illustrated with reference to the drawing, which depicts advantageous embodiment examples. In the drawing.

Figure 1:
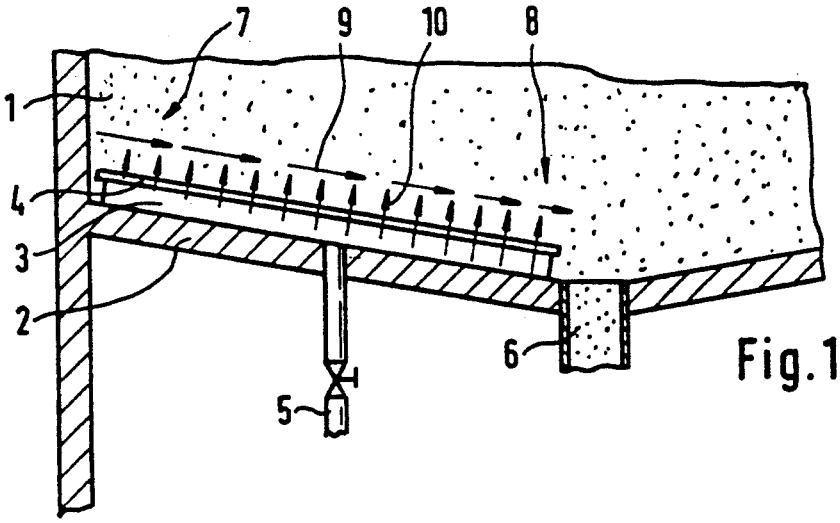
FIG. 1 is a schematic cross-section through the bottom region of a silo.

The bottom of a silo space 1 is formed above the supporting concrete bottom 2 by a venting apparatus which consists of so-called venting boxes which contain an air feed space 3 underneath an air-permeable layer 4.

This layer 4 possesses a fiber layer 4, for example a nonwoven or woven fabric made of polyester fibers, as element which introduces the air passing therethrough into the silo space 1 in finely divided form. The air feed space 3 can be supplied with compressed air via line 5 from a blower (not depicted). The air passes through the air-permeable layer 4 into the silo space in finely divided form. With the help of the air, the bulk material stored in the silo is vented in the vicinity of a bottom either over the entire bottom area or partially in one or more bottom sections and thereby converted into a fluid-like state. In this state it can flow toward the outlet 6 due to the slope of the bottom or due to pressure differences. Since its path passes in a more or less thin layer underneath the stationary material resting on top, it has to overcome a flow resistance which depends on the distance to the outlet and which in outlet-remote regions 7 is significantly greater than in outlet-close regions 8. This is indicated by the arrows 9 which decrease in magnitude from the outside toward the inside.

To compensate the effect of the distance from the outlet, the loosening air should be guided into the outlet-remote regions 7 at a higher pressure than into the outlet-close regions 8. The invention has recognized that the crucial factor for this is the pressure above the air-permeable layer 4, and therefore proposes that the air be slowed to a different degree within the air-permeable layer 4. Specifically, the air-permeable layer 4 is constructed in such a way that the flow resistance, indicated by the arrows 10, is correspondingly greater in the outlet-close region 8 in than in the outlet-remote region 7. Preferably, the flow resistance increases continuously from the outside toward the inside so as to prevent the formation of pressure discontinuities which might give rise to undesirable phenomena. However, in many cases, even a stepwise change in the flow resistance along the path of the material in the direction of the outlet will be sufficient.

Figure 2:
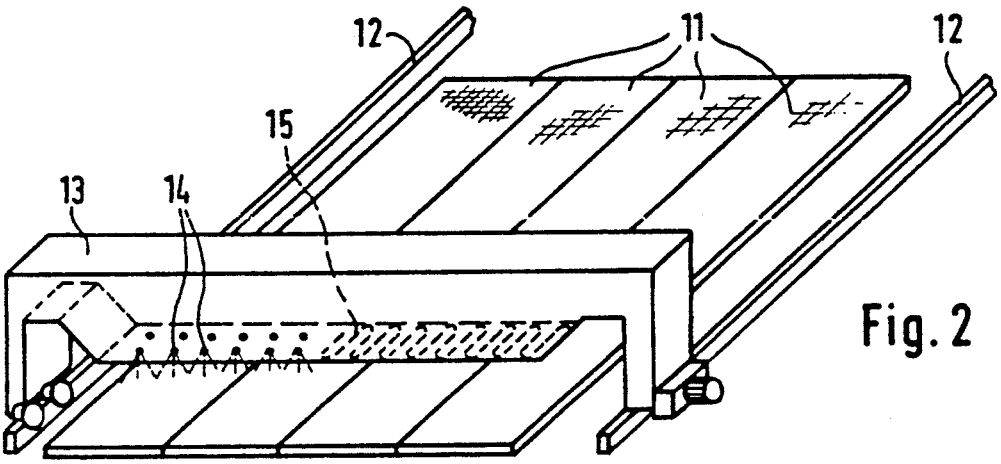
FIG. 2 is a view of an apparatus for influencing the flow resistance of a fiber layer.

Referring to FIG. 2, for this purpose the thermoplastic fabric (for example polyester fabric) used in the air-permeable layer is subjected to a treatment which closes or narrows some of the spaces within the fabric. According to FIG. 2, a number of lengths of fabric 11 to be treated lie between rails 12 supporting a bridge 13 which is equipped with spray nozzles 14 (on the left-hand side) or a heat radiator 15 (right-hand side) and travels at variable speed above the lengths of fabric 11 in the longitudinal direction thereof. The spray nozzles emit at a constant rate an impregnating agent which, after it has dried in the fabric 11, seals the pores thereof to a greater or lesser extent, depending on the add-on level. The heat radiator 15 brings about a softening of the thermoplastic fibers and thereby a partial fusion thereof, simultaneously with the effect of narrowing the flow channel cross-sections. In both cases, the effect depends on the duration of the treatment and thus on the rate of advance of the bridge. By controlling the rate of advance of the bridge in a suitable manner, it is thus possible to control the air permeability of the fabric 11. For example, the treatment can be started with a high rate of advance at one end of the fabric lengths 11 or within the end at a certain distance therefrom and be finished at the other end at a lower rate of advance.

Figure 3:
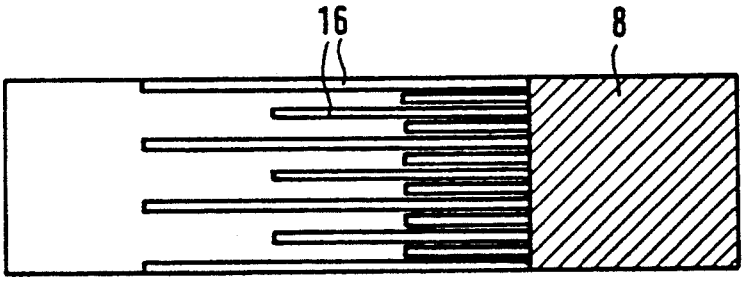
FIGS. 3 and 4 are plan views of fiber layers which contain patterns of areas of increased flow resistance.
Figure 4:
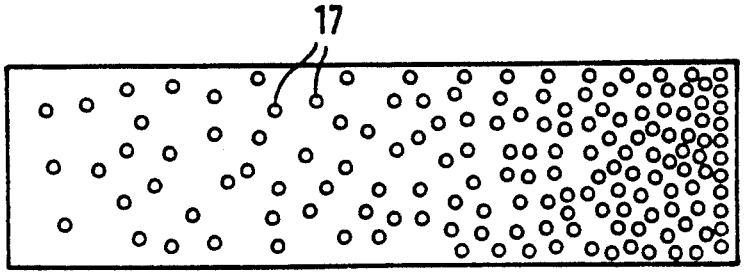

According to FIGS. 3 and 4, it is proposed that the fabric be provided with a pattern of compacted areas of increased flow resistance. Whereas in the case of FIG. 3 these areas have the form of strips 16 which extend in the longitudinal direction, in the example of FIG. 4 they take the form of points 17. In the example of FIG. 3 it is presupposed that these strips have a minimum permeability which corresponds to the value desired in the vicinity of the outlet, so that the outlet-close region 8 is 100% covered with compacted areas, while the density is correspondingly less in the other regions. In the embodiment example FIG. 4 it is assumed that the areas 17 have virtually no air permeability left, but are so small and so far apart from one another in all areas that a sufficiently uniform air distribution is achieved nonetheless.

In the embodiment example FIG. 3, the flow resistance increases discontinuously over a total of five stages. Such a stage by stage increase is in many cases a sufficiently good approximation to the ideal of a continuous change. In some cases it is even sufficient to have only two zones of differing flow resistance arranged in series on the path toward the outlet.

The flow resistance can increase linearly from the outside toward the inside. The preference in general is for a disproportionate increase. Suitable values can easily be determined by experiment for each case.

What is claimed is:

1. A bulk material silo whose bottom comprises an air-permeable fiber layer for the finely divided permeation of air from a compressed-air feed chamber situated underneath into the silo space situated above in order to render at least the layer of bulk material which is in immediate contact with the bottom free-flowing in such a way that it is capable of moving toward a pressure relief site, wherein the flow resistance offered by the air-permeable fiber layer increases along the path of the material toward the relief site.

2. A silo as claimed in claim 1, wherein the spaces between the fibers of the fiber layer have been filled to a degree which differs by region.

3. A silo as claimed in claim 2, wherein the spaces between the fibers contain an impregnation.

4. A silo as claimed in claim 1, wherein the fiber layer has been permanently compacted to a degree which differs by region.

5. A silo as claimed in claim 1, wherein the fiber layer contains small, essentially completely or highly enclosed areas and the proportion accounted for by these enclosed areas differs by region.

6. A silo as claimed in claim 1, wherein the fiber layer has been assembled from separate pieces of differing flow resistance.

7. A silo for storing and dispensing a bulk material, the silo comprising:

a housing having a bottom wall formed from an air-permeable fiber layer, and having a pressure relief site for dispensing the bulk material, and a compressed air feed chamber below the air-permeable fiber layer, adjacent the housing, the air-permeable fiber layer having means for providing an increasing flow resistance along the path of the bulk material in a direction toward the pressure relief site.

8. A silo according to claim 7, wherein the air-permeable fiber layer contains a filler disposed adjacent selected fibers of the fiber layer, the filler providing a reduction is permeability.

9. A silo according to claim 8 wherein the filler is an impregnation.

10. A silo according to claim 7 wherein the air-permeable fiber layer has a higher density at locations near the pressure relief site than at locations further from the pressure relief site.

11. A silo according to claim 7, wherein the air-permeable fiber layer has a plurality of substantially non-permeable enclosed areas, the proportion of the air-permeable fiber layer near the pressure relief site having enclosed areas being higher than the proportion of the air-permeable fiber layer further from the pressure relief site having enclosed areas.

12. A silo according to claim 7, wherein the air-permeable fiber layer comprises a plurality of pieces having different degrees of permeability.

13. A silo according to claim 12, wherein the plurality of pieces comprise parallel strips.

* * * * *